United States Patent [19]

Labelle

[11] Patent Number: 4,571,889

[45] Date of Patent: Feb. 25, 1986

[54] ROLLING CLOSURE BOTTOM SEAL

[75] Inventor: H. M. Robert Labelle, Cornwall, Canada

[73] Assignee: Martinray Industries Ltd., Cornwall, Canada

[21] Appl. No.: 573,673

[22] Filed: Jan. 25, 1984

[30] Foreign Application Priority Data

May 19, 1983 [CA] Canada ..... 428518

[51] Int. Cl.[4] ..... E06B 7/15

[52] U.S. Cl. ..... 49/482; 49/488; 49/499

[58] Field of Search ..... 49/488, 499, 482, 468, 49/470

[56] References Cited

U.S. PATENT DOCUMENTS

| | | | |
|---|---|---|---|
| 3,114,946 | 12/1963 | Fluck | 49/470 |
| 3,324,598 | 6/1967 | Tinfow et al. | 49/488 |
| 3,374,580 | 3/1968 | Ruff | 49/482 |
| 4,224,767 | 9/1980 | Jecmen | 49/499 X |

*Primary Examiner*—Kenneth Downey

*Attorney, Agent, or Firm*—Charles E. Brown; Charles A. Brown

[57] ABSTRACT

Sealing means for the bottom of a rolling closure which sealing means can be adjustably mounted on the closure. The adjustable mounting provides a seal of substantially uniform size irregardless of which one of several panel thicknesses make up the closure.

6 Claims, 4 Drawing Figures

ROLLING CLOSURE BOTTOM SEAL

BACKGROUND OF THE INVENTION

1. FIELD OF THE INVENTION

This invention is directed toward sealing means for a closure.

The invention is more particularly directed toward adjustably mounted sealing means for the bottom of a rolling closure, and particularly for the reinforced bottom of a rolling closure.

2. DESCRIPTION OF THE PRIOR ART

Rolling closures are built in size to nearly, but not completely, close openings. In the closed position of the rolling closure, a slight gap exists between the bottom of the closure and the bottom of the opening. This gap is normally closed by sealing means fastened on the bottom of the closure. One simple form of sealing means which can be employed on the bottom of the closure uses a flexible strip of material. A pair of suitable mounting means are provided on the bottom of the closure, one on the bottom front edge of the closure and one on the bottom, back edge of the closure. Mounting means on the sides of the strip cooperate with the mounting means on the bottom of the closure to hang the strip from the bottom of the closure in a downwardly depending loop to form a seal.

If the closure is made in any one of several different thicknesses, the distance between the mounting means on the closure bottom can vary requiring different widths of sealing strips to close the same size of bottom gap. Alternatively, the different width closures can be made with different bottoms, each closure bottom providing the same distance between the mounting means so that only one size of sealing strip is needed. In either case however different sizes of sealing strips or of closure bottoms, are needed to provide the same bottom seal for closures of different thickness and this is expensive.

SUMMARY OF THE INVENTION

It is therefore the purpose of the present invention to provide sealing means on the bottom of a rolling closure which can be adjustably mounted to accomodate closures of different thickness in a relatively simple and inexpensive manner.

The bottom of rolling closures can be easily damaged and it is known to reinforce the bottom edge to minimize damage. In accordance with the preferred embodiment of the present invention, a reinforcement member employed to strengthen the bottom of a rolling closure is also employed in adjustably mounting the sealing means to the closure in a manner to accomodate closures of different thickness. The single reinforcement member thus is employed for two functions simultaneously thereby further reducing expense.

In accordance with the present invention, the sealing means employs a sealing strip of one width for all thicknesses of closure. First mounting means are provided in one location on the bottom of the closure to receive one side of the sealing strip. Two or more other spaced-apart mounting means are provided on the bottom of the closure, spaced from the first mounting means. The other side of the sealing strip is mounted in one of these other mounting means. Which one of the other mounting means is employed is dependent on the thickness of the closure in order to always provide the same size of loop as formed by the strip. The first mounting means is provided in the same location on the bottom side of the bottom closure panel irregardless of the width of the panel. The two or more other mounting means are preferably provided on the bottom side of the reinforcing member which is attached to the side of the bottom closure panel. Thus the distance of the other mounting means from the one mounting means varies according to the thickness of the bottom panel. However one of the other mounting means is always in the proper position to receive the other side of the sealing strip to form a loop of the proper size irregardless of which of several panel widths is used.

The invention is particularly directed toward a closure having a bottom surface and a flexible sealing strip having first mounting means on one side of the strip and second mounting means, parallel to the first mounting means, on the other side of the strip. A first mounting means is provided on the bottom surface of the closure and at least two other spaced-apart mounting means are provided on the bottom surface of the closure, spaced from the first mounting means. The first mounting means on the strip is mounted in the first mounting means on the closure and the second mounting means on the strip is mounted in one of the other mounting means on the closure dependent on the thickness of the closure.

The closure has a bottom panel with its bottom side forming part of the bottom surface of the closure. The closure also has a reinforcing member mounted to the bottom panel with the bottom side of the reinforcing member forming the other part of the bottom surface of the closure. The first mounting means in the closure is in the bottom side of the bottom panel. The other mounting means in the closure are in the bottom side of the reinforcing member.

BRIEF DESCRIPTION OF THE DRAWINGS

The invention will now be described in detail having reference to the accompanying drawings in which.

DESCRIPTION OF THE PREFERRED EMBODIMENTS

Figure 1:
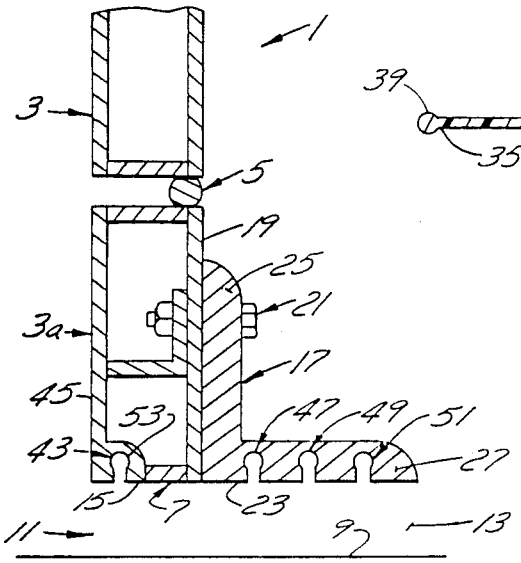
FIG. 1 is a cross-section view of the bottom of a closure.

The rolling closure 1, as shown in FIG. 1, comprises a series of panels or slats 3 pivotally joined together by suitable hinge means 5 at their adjacent long sides. The bottom surface 7 of the rolling closure is positioned close to the bottom 9 of an opening 11 when the closure 1 closes opening 11. There is a gap 13 however between the bottom surface 7 of the closure 1, and the bottom 9 of the opening 11.

The bottom side 15 of the lowermost panel 3*a* in the closure 1 forms part of the bottom surface 7 of the closure. A reinforcing member 17, part of the closure 1, is mounted to the inside 19 of the bottom panel 3*a* by suitable fastening means 21. The bottom side 23 of the reinforcing member 17 forms the remaining part of the bottom surface 7 of the closure 1. The two bottom sides 15, 23 of the panel 3*a*, and member 17 respectively, preferably are aligned and parallel to the bottom 9 of opening 11.

The reinforcing member 17 preferably comprises an angle member having one leg 25 fastened to the inside 19 of the bottom panel 3*a*. The other leg 27 extends transversely away from the inside 19 of the bottom panel 3*a* with its outer side forming the bottom side 23 of the reinforcing member 17. The reinforcing member 17 stiffens the bottom edge of the closure 1, making it stronger. The reinforcing member 17 also provides an enlarged area for use in mounting a sealing member 31 to the bottom edge of the closure as will be described.

Figure 2:
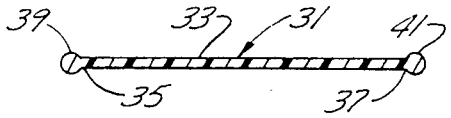
FIG. 2 is a cross-section view of a sealing strip.

The sealing member 31, as shown in FIG. 2, comprises a long, narrow strip 33 of flexible, preferably resilient, material having a first long side 35 and a parallel second long side 37. First mounting means in the form of a rib 39 are provided on the first side 35 of the strip 33, and second mounting means, also in the form of a rib 41, are provided on the second side 37 of the strip. The ribs 39, 41 have the same cross-sectional shape, preferably circular, and have a diameter larger than the thickness of strip 33.

Means are provided in the bottom surface 7 of the rolling closure 1 for detachably adjustably mounting the sealing strip 33 thereto to form sealing means for the closure. The mounting means includes a first mounting groove 43 located in the bottom side 15 of the bottom panel 3*a*. This first mounting groove 43 preferably is formed in the bottom of the front wall 45 of the panel. Two or more other, spaced-apart mounting grooves are located in the bottom side 23 of the reinforcing member 17 in its other leg 27. Three other mounting grooves 47, 49, 51 are shown in leg 27 in FIG. 1. The first and the other mounting grooves 43, 47, 49, 51 are all identical with each groove having a base 53 with a cross-sectional shape substantially the same as the cross-sectional shape of the ribs 39, 41 on the sealing member 31. Each groove also has a slot, substantially equal in width to the thickness of the strip 33 of the sealing member 31, providing entry to the base 53. The grooves 43, 47, 49, 51 extend across the width of the closure 1 and are parallel to each other, and to the front wall 45 of the panel 3*a*.

Figure 3A:
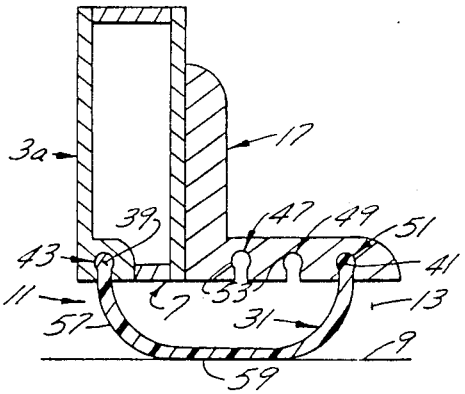
FIG. 3*a* is a cross-section view of the closure bottom with a thin panel.

The sealing member 31 is mounted on the closure 1 by sliding its first mounting means, rib 39, into the first mounting groove 43 in the bottom panel 3*a* of the closure. The second mounting means, rib 41, on sealing member 31, is simultaneously slid into one of the grooves 47, 49, 51 in the reinforcing member 17. The strip 33 is suspended from the bottom surface 7 of the closure 1 by its ribs 39, 41 forming a loop 57, the bottom 59 of which rests on the bottom 9 of the opening 11, as shown in FIG. 3*a*. The loop 57 closes the gap 13 between the bottom 7 of the closure 1 and the bottom 9 of the opening 11.

Figure 3B:
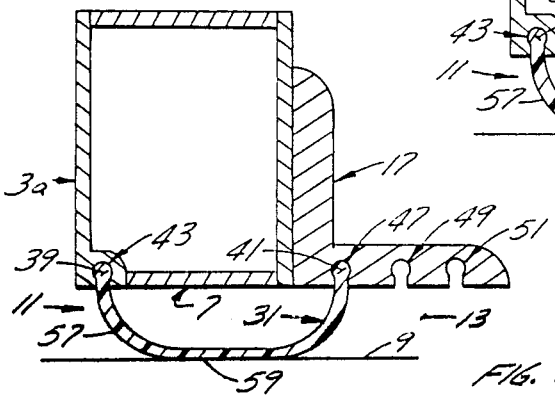
FIG. 3*b* is a cross-section view of the closure bottom with a thick panel.

The other grooves 47, 49, 51 in the reinforcing member 17 permit adjustment in the mounting of the sealing member 31 on the closure 1. When the closure employs narrow panels 3, one inch thick for example, the second mounting means, rib 41, on sealing member 31 is mounted in the other mounting groove 51 farthest removed from the first mounting groove 43, as shown in FIG. 3*a*. When the closure employs thick panels 3, two inches thick for example, the second mounting rib 41 is mounted in the other mounting groove 47 closest to the first mounting groove 43 as shown in FIG. 3*b*. This arrangement permits the sealing member 31 to properly close gap 13 irregardless of whether a thick or thin panel 3 is used in the closure. If a medium thick panel 3 is used, groove 49 is used to mount the sealing member 31.

I claim:

1. A closure; a flexible sealing strip for the closure having first mounting means on one side of the strip, and second mounting means, parallel to the first mounting means on the other side of the strip; a first sealing strip mounting means in a first location on the bottom of the closure; a sealing strip mounting member fixed to the bottom of the closure in a second location spaced from the first location, the distance between the first and second locations varying depending on the thickness of the closure; and at least two other spaced-apart sealing strip mounting means on the bottom of the mounting member, whereby the first mounting means of the sealing strip can be mounted in the first sealing strip mounting means on the closure and the second mounting means on the sealing strip can be mounted in one of the other sealing strip mounting means in the sealing strip mounting member, the one of the other sealing strip mounting means selected dependent on the thickness of the closure.

2. A closure as claimed in claim 1 wherein the first sealing strip mounting means is integrally formed in the bottom of a side panel of the closure.

3. A closure as claimed in claim 1 wherein the sealing strip mounting member comprises an angle member with one leg attached to one side of the closure and with the other leg level with the bottom of the closure, the other spaced-apart sealing strip mounting means formed in the bottom surface of the other leg.

4. A closure as claimed in claim 3 wherein the first sealing strip mounting means is integrally formed in the bottom of a side panel of the closure on the other side to the one side.

5. A closure as claimed in claim 1 wherein all the sealing strip mounting means extend across the width of the closure parallel to each other and to the sides of the closure.

6. A closure having a bottom panel with the bottom side of the bottom panel forming part of a bottom surface of the closure; a reinforcing member mounted to the bottom panel with the bottom side of the reinforcing member forming the other part of the bottom surface; the bottom side of the bottom panel and the bottom side of the reinforcing member being aligned; a flexible sealing strip having first mounting means on one side of the strip and second mounting means, parallel to the first mounting means, on the other side of the strip; a first mounting means in the bottom side of the bottom panel; at least two spaced-apart mounting means, spaced from the first mounting means, in the bottom side of the reinforcing member; the first and the other mounting means extending across the width of the closure parallel to each other and to the front or back side of the closure; whereby the first mounting means on the strip is mounted in the first mounting means on the bottom panel of the closure and the second mounting means on the strip is mounted in one of the other mounting means on the reinforcing member dependent on the thickness of the closure.

* * * * *